US007845922B2

(12) United States Patent
Langenbach et al.

(10) Patent No.: US 7,845,922 B2
(45) Date of Patent: Dec. 7, 2010

(54) VANE PUMP

(75) Inventors: Christian Langenbach, Affalterbach (DE); Arno Lorenz, Renningen (DE); Rocco Guarino, Turi (IT); Vito Spinelli, Sammichele Di Bari (IT)

(73) Assignee: Robert Bosch GmbH, Stuttgart (DE)

( * ) Notice: Subject to any disclaimer, the term of this patent is extended or adjusted under 35 U.S.C. 154(b) by 295 days.

(21) Appl. No.: 12/088,294

(22) PCT Filed: Sep. 11, 2006

(86) PCT No.: PCT/EP2006/066201

§ 371 (c)(1),
(2), (4) Date: Mar. 27, 2008

(87) PCT Pub. No.: WO2007/039405

PCT Pub. Date: Apr. 12, 2007

(65) Prior Publication Data

US 2008/0253913 A1 Oct. 16, 2008

(30) Foreign Application Priority Data

Sep. 30, 2005 (DE) ..... 10 2005 047 175

(51) Int. Cl.
*F04C 18/324* (2006.01)
*F04C 2/324* (2006.01)
*F04C 2/344* (2006.01)
*F01C 21/08* (2006.01)

(52) U.S. Cl. ..... 418/268; 418/79; 418/81; 418/82

(58) Field of Classification Search ..... 418/225, 418/268, 259, 79, 80, 81, 82, 232, 266, 267
See application file for complete search history.

(56) References Cited

U.S. PATENT DOCUMENTS

| | | | | |
|---|---|---|---|---|
| 2,004,958 | A | | 6/1935 | Bryce |
| 2,423,271 | A | | 7/1947 | Talbot |
| 2,544,987 | A | | 3/1951 | Gardiner et al. |
| 2,653,550 | A | * | 9/1953 | Gardiner et al. ..... 418/133 |
| 3,574,493 | A | * | 4/1971 | Hamilton ..... 418/268 |
| 4,455,129 | A | | 6/1984 | Sakitani et al. |

(Continued)

FOREIGN PATENT DOCUMENTS

CN 101080572 A 11/2007

(Continued)

*Primary Examiner*—Thomas E Denion
*Assistant Examiner*—Mary A Davis
(74) *Attorney, Agent, or Firm*—Ronald E. Greigg

(57) ABSTRACT

The invention relates to a vane pump comprising a rotor which is arranged therein, rotatably driven by a drive shaft. The rotor is provided with several grooves which are distributed through the circumference thereof and which extend substantially radially with respect to the axis of rotation of the rotor. In each groove a blade-shaped conveying element is slidingly guided. The end walls of the pump housing are adjacent to the rotor in the direction of the axis of rotation thereof. At least one ring-shaped groove surrounding the axis of rotation of the rotor is embodied in at least one front side of the rotor. The ring-shaped groove is connected to lower areas restricted by the blades in the grooves of the rotor, and to pressure areas. In a preferred embodiment, the ring-shaped groove is formed in the rotor by shaping.

13 Claims, 4 Drawing Sheets

U.S. PATENT DOCUMENTS

| | | | | |
|---|---|---|---|---|
| 5,147,183 | A | 9/1992 | Gettel | |
| 5,188,522 | A * | 2/1993 | Hara | 418/268 |
| 5,265,457 | A | 11/1993 | Hayashi et al. | |
| 2009/0291010 | A1 | 11/2009 | Koehler et al. | |

FOREIGN PATENT DOCUMENTS

| | | | |
|---|---|---|---|
| DE | 19529806 | A1 | 2/1997 |
| DE | 199 52 167 | A1 | 6/2000 |
| DE | 102004060554 | A1 | 6/2006 |
| GB | 186271 | | 9/1922 |
| JP | 63167089 | A * | 7/1988 |
| JP | 63280883 | A | 11/1988 |
| JP | 1-155096 | | 6/1989 |
| JP | 2008524485 | A | 7/2008 |
| WO | 2006063913 | A1 | 6/2006 |

* cited by examiner

VANE PUMP

CROSS-REFERENCE TO RELATED APPLICATION

This application is a 35 USC 371 application of PCT/EP 2005/066201 filed on 11 Sep. 2006.

BACKGROUND OF THE INVENTION

1. Field of the Invention

The invention is based on a vane pump.

2. Description of the Prior Art

A vane pump of this kind is known from DE 199 52 167 A1. This vane pump has a pump housing that contains a rotor, which is rotatably driven by a drive shaft. The rotor has a plurality of grooves distributed over its circumference that extend at least essentially radially in relation to the rotation axis of the rotor, with a vane-shaped delivery element guided in each groove in sliding fashion. The pump housing has a circumference wall encompassing the rotor, eccentric to the rotor's rotation axis, against which the radially outer ends of the vanes rest. The pump housing has housing end walls that adjoin the rotor in the direction of its rotation axis. Due to the eccentric arrangement of the circumference wall as the rotor rotates, expanding and contracting chambers are formed between the vanes and by means of a pressure increase, the medium to be supplied is fed from a suction region to a pressure region that is offset from it in the circumference direction. As the rotor rotates, centrifugal force holds the vanes in contact with the circumference wall; but when the vane pump is being started, at low rotation speed, only slight centrifugal forces are exerted so that the vane pump only delivers a small quantity. In the known vane pump, another feed pump that forms a combined pump apparatus with the vane pump supplies compressed medium into the internal regions delimited by the vanes in the grooves of the rotor, which causes the vanes to be pressed radially outward toward the circumference wall in addition to the centrifugal force. In this case, at least one housing end wall contains an annular groove, which extends over part of the circumference of the rotor and is supplied with compressed medium by the additional feed pump. Manufacturing the annular groove in the housing end wall in this case is complex and usually has to be carried out by means of a material-removing machining process such as milling.

SUMMARY AND ADVANTAGES OF THE INVENTION

The vane pump according to the invention has the advantage over the prior art that its manufacture is simplified in that the at least one annular groove can be produced more easily in the rotor than in the housing end wall.

The invention permits an exertion of pressure on both sides of the rotor so that at least essentially no axial forces act on it and the wear on the rotor and the housing end walls can be kept to a minimum. The invention makes it possible to at least almost completely prevent the exertion of axial forces on the rotor with a simultaneously limited span of the annular grooves in the two end surfaces of the rotor. It is particularly advantageous in that one annular groove only connects two successive grooves in the rotor to each other since this makes it possible to minimize possible leakage losses.

DESCRIPTION OF THE PREFERRED EMBODIMENTS

Figure 1:
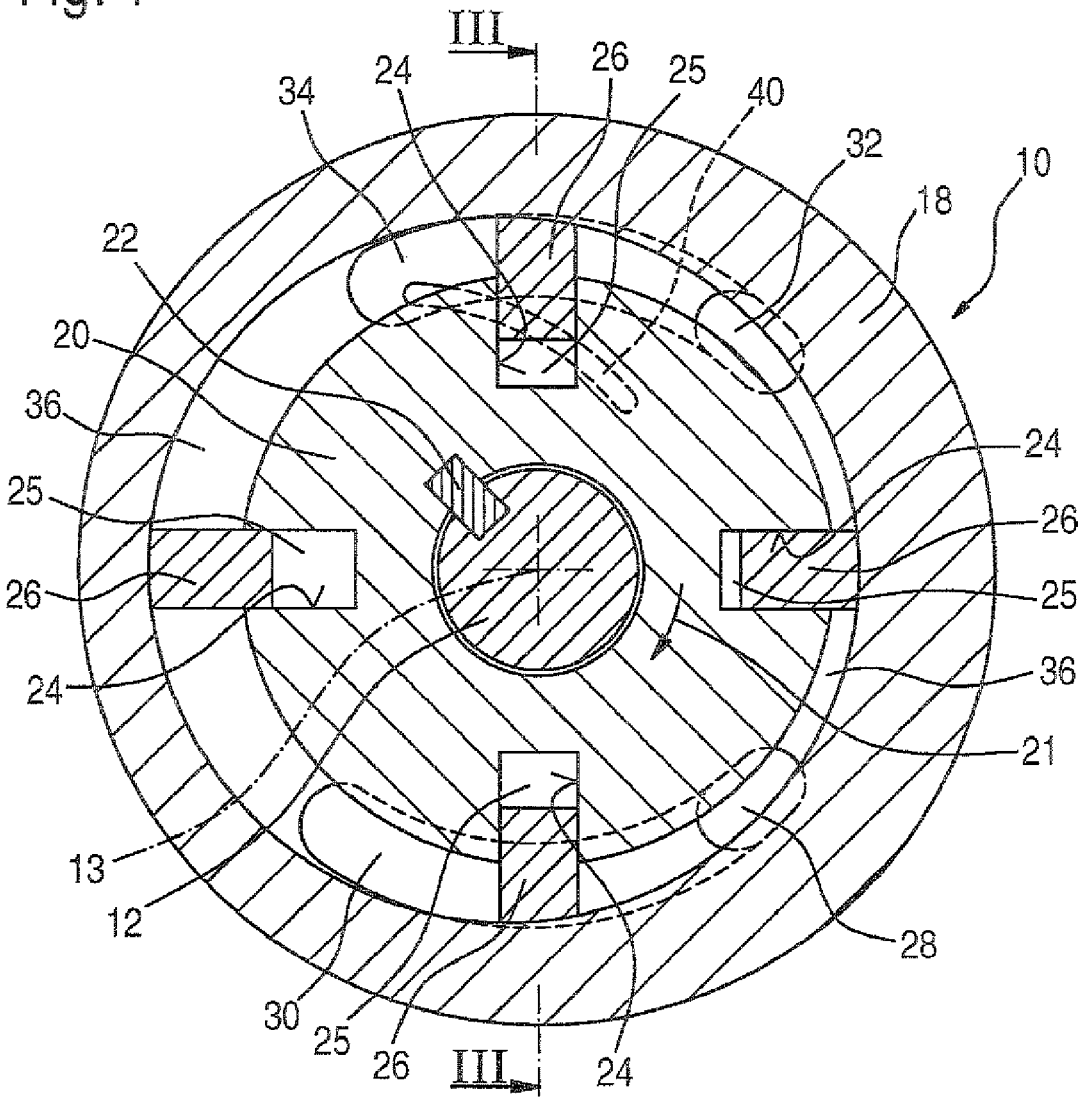
FIG. 1 is a simplified cross section through a vane pump, extending along the line I-I in FIG. 3.

FIGS. 1 through 4 show a vane pump that is preferably provided for delivering fuel, in particular diesel fuel. In this case, the vane pump delivers fuel from a tank to a high-pressure pump. The vane pump can either be situated separately from the high-pressure pump, attached to the high-pressure pump, or integrated into the high-pressure pump. The vane pump has a pump housing 10, which is comprised of multiple parts, and a drive shaft 12 that protrudes into the pump housing 10. The pump housing 10 has two housing end walls 14, 16 that delimit a pump chamber in the axial direction, i.e. in the direction of the rotation axis 13 of the drive shaft 12. In the circumference direction, the pump chamber is delimited by a circumference wall 18 that can be embodied as integrally joined to one of the housing end walls 14, 16 or can be separate from them. The rotor 20 has end surfaces 201 and 202 oriented toward the housing end walls 14, 16.

Figure 3:
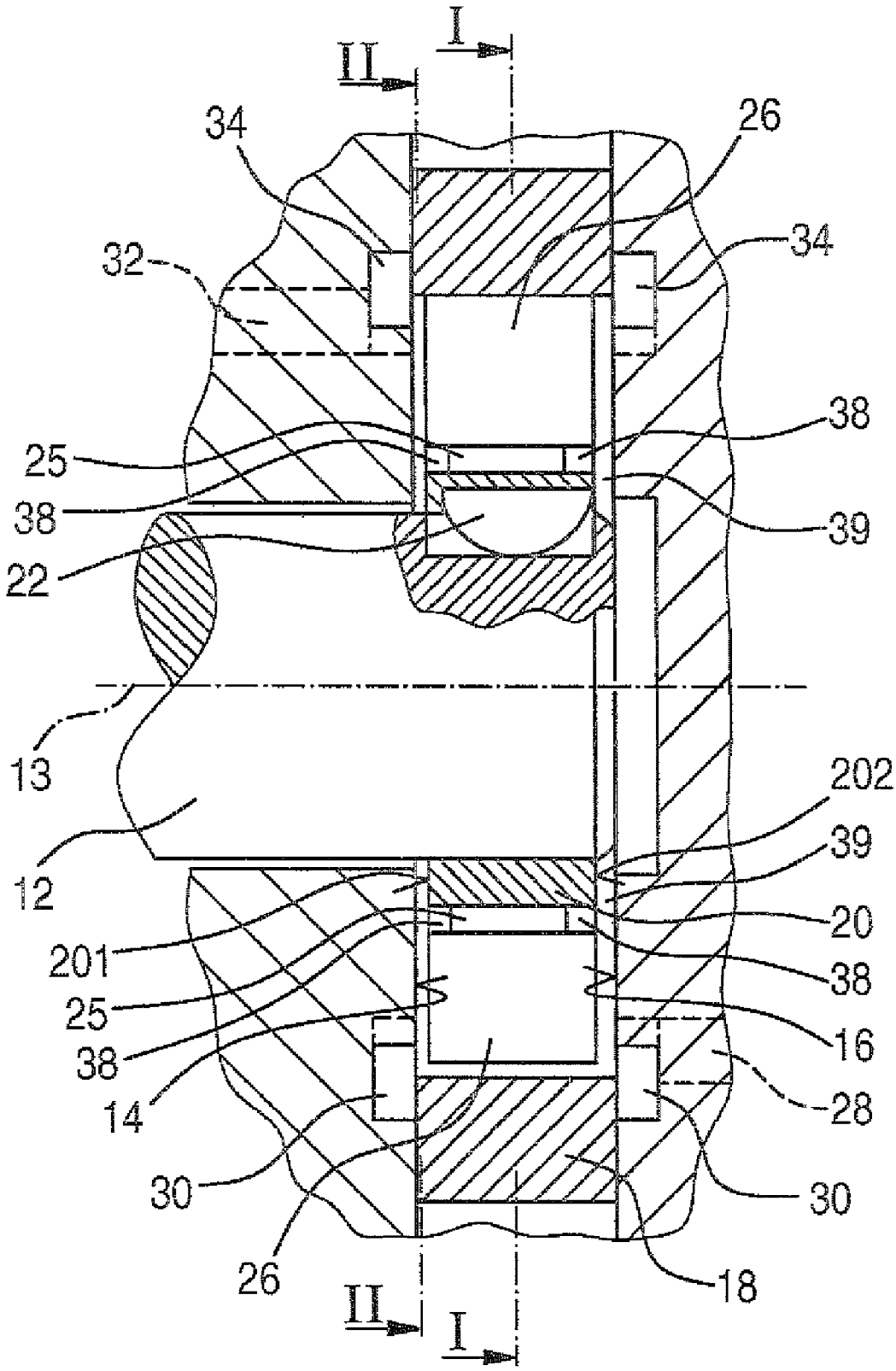
FIG. 3 is a longitudinal section through the vane pump, extending along the line III-III in FIG. 1.
Figure 4:
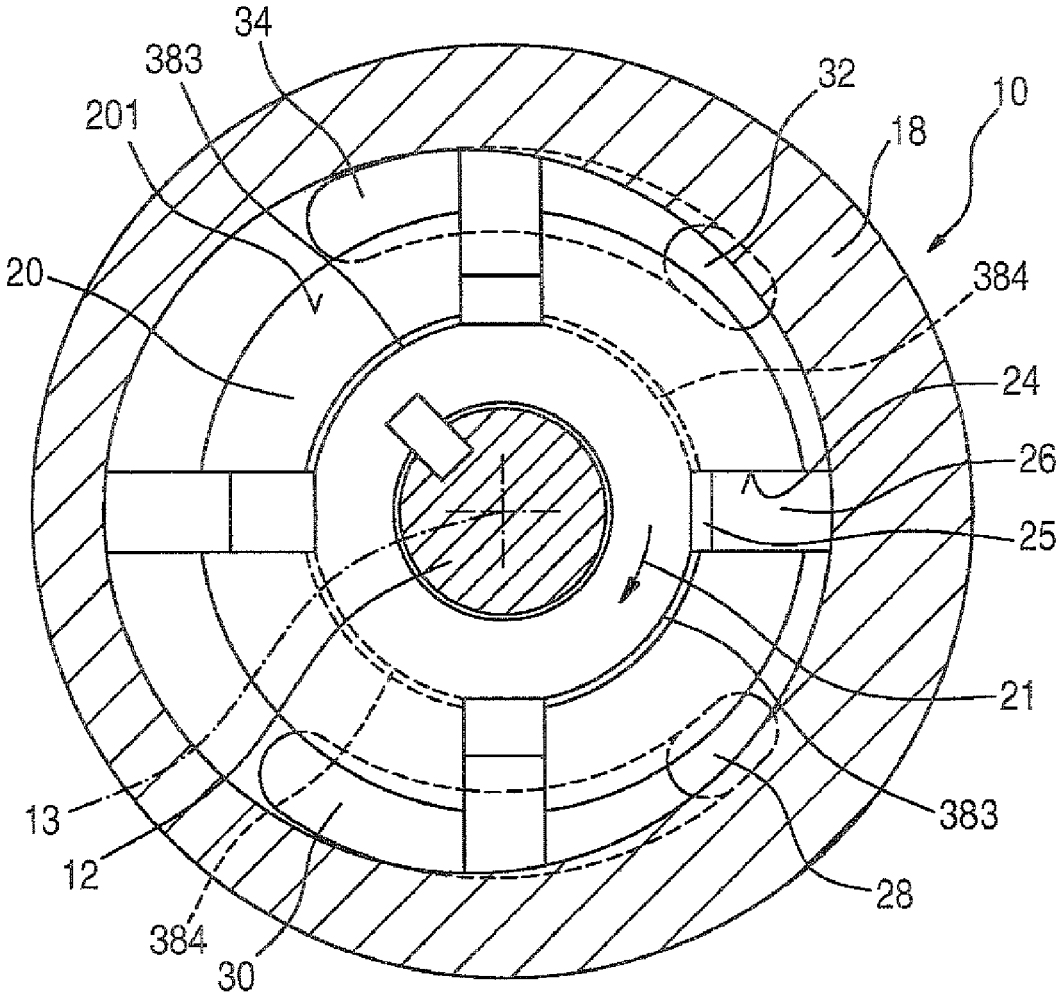
FIG. 4 is a cross section through the vane pump, extending along the line II-II, according to a second exemplary embodiment.

As depicted in FIGS. 1, 3, and 4, the pump chamber contains a rotor 20 that is attached in nonrotating fashion to the drive shaft 12, for example by means of a groove/spring connection 22. The rotor 20 has a plurality of grooves 24 that are distributed over its circumference and extend at least essentially radially in relation to the rotation axis 13 of the rotor 20. The grooves 24 extend into the rotor 20 from its outer circumference toward the rotation axis 13. For example, four grooves 24 are provided; it is also possible for more or less than four grooves 24 to be provided. Each groove 24 accommodates a plate-shaped delivery element 26 in sliding fashion, which will be referred to below as a vane and whose radially outer end region protrudes out from the groove 24. Each vane 26 delimits a radially inner internal region 25 in the respective groove 24.

Figure 2:
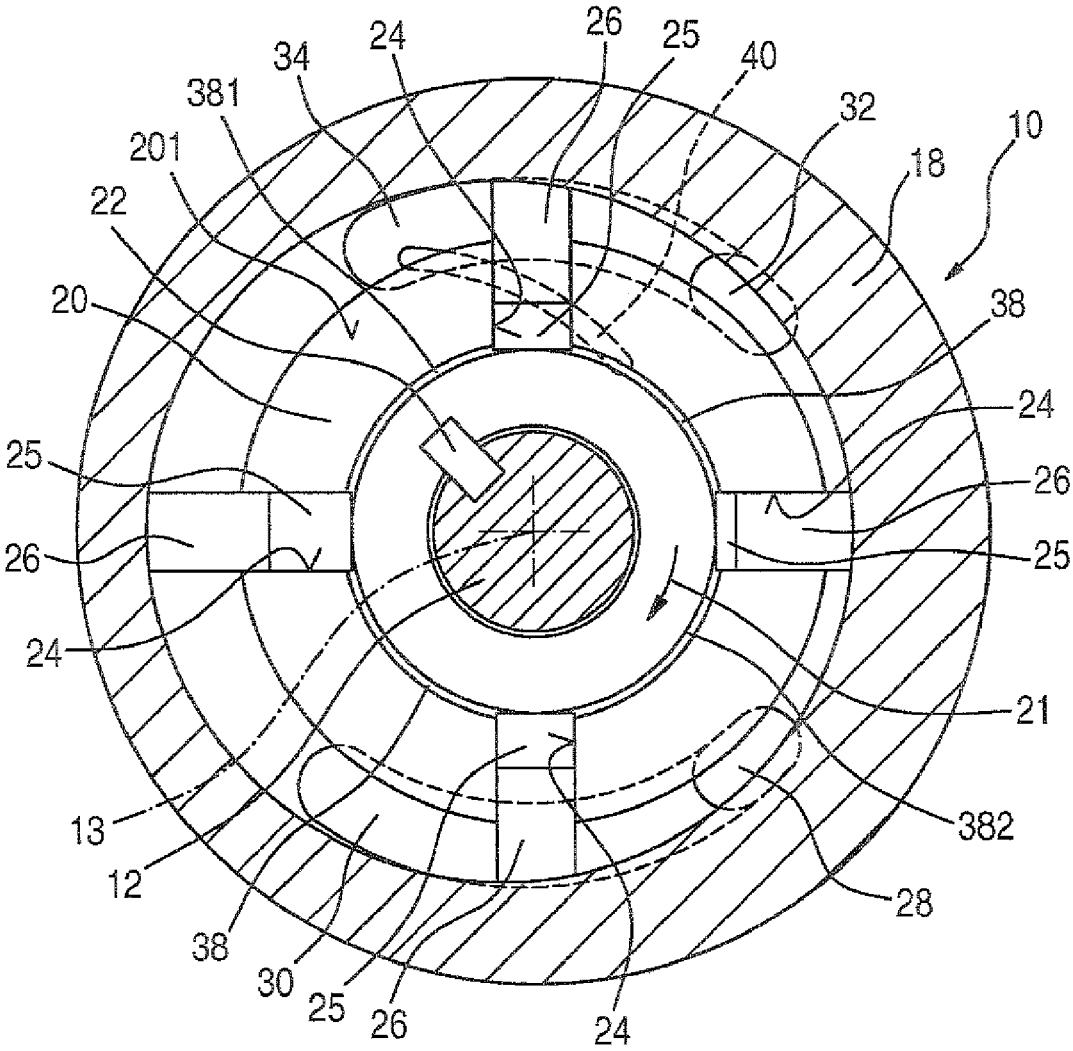
FIG. 2 is a cross section through the vane pump, extending along the line II-II in FIG. 3, according to a first exemplary embodiment.

The inside of the circumference wall 18 of the pump housing 10 is situated eccentrically in relation to the rotation axis 13 of the rotor 20, for example in circular fashion or in another form. In at least one housing end wall 14, 16 a suction region is provided, as depicted in FIG. 2, into which at least one suction opening 28 feeds. In the suction region, a suction groove 30 is preferably provided in at least one housing end wall 14, 16; this groove is elongated in the circumference direction of the rotor 20 and is curved in an approximately kidney-shaped fashion and the suction opening 28 feeds into it. The suction opening 28 preferably feeds into the suction groove 30 in its end region oriented away from the rotation direction 21 of the rotor 20. The suction opening 28 is connected to a supply line leading from the tank. In addition, a pressure region is also provided in at least one housing end wall 14, 16, into which region at least one pressure opening 32 feeds. In the pressure region, a pressure groove 34 is preferably provided in at least one housing end wall 14, 16; this groove is elongated in the circumference direction of the rotor 20 and is curved in an approximately kidney-shaped fashion and the pressure opening 32 feeds into it. The pressure opening 32 preferably feeds into the pressure groove 34 in its end region oriented in the rotation direction 21 of the rotor 20. The pressure opening 32 is connected to an outlet leading to the high-pressure pump. The suction opening 28, the suction groove 30, the pressure opening 32, and the pressure groove 34 are spaced radially apart from the rotation axis 13 of the rotor 20 and are situated close to the inside of the circumference wall 18. The radially outer ends of the vanes 26 rest against the inside of the circumference wall 18 and slide along it during the rotating motion of the rotor 20 in the rotation direction 21. Due to the eccentric arrangement of the inside of the circumference wall 18 in relation to the rotation axis 13 of the rotor 20, chambers 36 with different volumes are formed between the vanes 26. The suction groove 30 and the suction opening are situated in a circumference region in which, with a rotating motion in the rotation direction 21 of the rotor 20, the volume of the chambers 36 increases so that they are filled with fuel. The pressure groove 34 and the pressure opening 32 are situated in a circumference region in which, with a rotating motion in the rotation direction 21 of the rotor 20, the volume of the chambers 36 decreases so that fuel is displaced from the chambers into the pressure groove 34 and from it, into the pressure opening 32.

In a first exemplary embodiment shown in FIG. 2, in at least one end wall 201, 202 (FIG. 3) of the rotor 20 a ring-shaped groove 38 is provided, which extends over the entire circumference of the rotor 20 and communicates with the respective internal regions 25 that are delimited by each vane 26 in its respective groove 24. The ring-shaped groove 38 will be referred to below as the annular groove 38. For example, the annular groove 38 can extend so that its radially inner edge extends at least approximately at the same radial distance from the rotation axis 13 of the rotor 20 as the radially inner edges of the grooves 24 in the rotor 20; in this case, the annular groove 38 then feeds into the grooves 24 in approximately tangential fashion. It is also possible for the radially inner edge of the annular groove 38 to extend spaced a smaller radial distance apart from the rotation axis 13 than the radially inner edges of the grooves 24; in this case, the annular groove 38 then feeds into the groove 28 in an approximately radial fashion, for example. The annular groove 38 can also extend spaced a smaller radial distance apart from the rotation axis 13 than the radially inner edges of the grooves 24 and be connected to the internal regions 25 of the grooves 24 via an additional respective groove in the rotor 20. The annular groove 38 can also extend spaced a greater radial distance apart from the rotation axis 13 than the radially inner edges of the grooves 24, but should be spaced a smaller radial distance apart from the rotation axis 13 than the radially inner ends of the vanes 26. The grooves 24 subdivide the annular groove 38 into a plurality of annular groove sections. It is possible for a respective annular groove 38 to be provided in both end surfaces 201, 202 of the rotor 20 or it is alternatively possible for an annular groove 38 to be provided in only one end surface 201 or 202 of the rotor 20. In the housing end wall 14, 16 oriented toward the end surface 201, 202 of the rotor 20 in which the annular groove 38 is situated, a connecting groove 40 leads inward from the pressure groove 34 and ends approximately the same distance apart from the rotation axis 13 as the annular groove 38, thus connecting the annular groove 38 to the pressure groove 34 and therefore to the pressure region. In lieu of the connecting groove 40, it is also possible for a connecting bore to be provided. Between the annular groove 38 and the drive shaft 12, a sealing region 39 is formed in which there is only a slight axial distance between the rotor 20 and the adjacent housing end wall 14, 16. In the region around the drive shaft 12, only a slight pressure prevails so that there is a pressure difference between the annular groove 38 and the region around the drive shaft 12.

It is also possible for the annular groove 38 on one end surface 201 or 202 to extend not over the entire circumference of the rotor 38, but instead over only a part of the circumference; it is also possible to provide several annular grooves 38 that are offset from one another in the circumference direction. For example, several annular grooves 38 can be provided, each of which connects only the internal regions 25 of two successive grooves 24 of the rotor 20 to each other. This eliminates two sections 381, 382 of the annular groove 38 in the embodiment according to FIG. 2. A two-sided, symmetrical arrangement of the annular grooves 38 on the rotor 20 offers the advantage that almost no resulting forces are exerted on the rotor 20 in the direction of its rotation axis 13 and no tilting moments are exerted perpendicular to the rotation axis 13 so that the rotor 20 rotates at least approximately in the middle between the two housing end walls 14, 16, without coming into contact with them. If respective sections of annular grooves 38 that do not extend over the entire circumference of the rotor 20 are provided in both end walls 201, 202 of the rotor 20, it is then possible to minimize the leakage through the sealing region 39.

The connecting groove 40 can extend inward from the pressure groove 34, for example radially, or can be inclined in relation to a line radial to the rotation axis 13. In particular, the connecting groove 40 can extend in such a way that it approaches the annular groove 38 in the rotation direction 21 of the rotor 20. In addition, the connecting groove 40 can be curved in spiral fashion. One end of the connecting groove 40 preferably feeds at least approximately tangentially into the pressure groove 34 and/or the other end feeds at least approximately tangentially into the annular groove 38. Preferably, the connecting groove 40 feeds into the end region of the pressure groove 34 oriented away from the rotation direction 21 of the rotor 20. The connection of the annular groove 38 to the pressure groove 34 causes an elevated pressure to prevail in the annular groove 38 and therefore in the internal regions 25 of the grooves 24 of the rotor 20 connected to it, thus intensifying the contact force of the vanes 26 against the inside of the circumference wall 18 and improving the delivery capacity of the vane pump.

The at least one annular groove 38 is preferably provided in the rotor 20 by the initial shaping process and not by a material-removing machining process. For example, the rotor 20 can be manufactured by means of a pressing or forging process; in this case, the at least one annular groove 38 is formed in the rotor 20 through a corresponding shape of the pressing or forging die during the manufacture of the rotor 20. In particular, the rotor 20 can be composed of sintered metal in order to assure a sufficient strength and wear resistance of the rotor 20.

It is possible for the connecting groove 40 that connects the annular groove 38 to the pressure groove 34 to be provided in only one housing end wall 14 or 16; it is also possible for at least one connecting groove 40 to be provided in both housing end walls 14 and 16, with the respective connecting grooves 40 being situated in mirror image fashion in relation to each other in the housing end walls 14 and 16. It is also possible for the suction groove 30 and/or the pressure groove 34 to be provided in only one housing end wall 14 or 16, with the respective other housing end wall 16 or 14 being embodied as smooth, or for a suction groove 30 and pressure groove 34 to be provided in respective housing end walls 14 and 16, with the respective suction and pressure grooves being situated in mirror image fashion in relation to each other in the housing end walls 14 and 16. In this case, the suction opening 28 and pressure opening 32 are each provided in only one respective housing end wall 14 or 16; the suction opening 28 is provided in one housing end wall 14 and the pressure opening 32 is provided in the other housing wall 16. Due to the mirror-image arrangement of the suction groove 30 and pressure groove 34 and of the annular grooves 38 and connecting grooves 40 in the two housing end walls 14 and 16, the rotor 20 and the vanes 26 are subjected to at least approximately the same load in the axial direction at both ends, thus producing little or no resulting force on the rotor 20 and vanes 26 in the direction of the rotation axis 13. The depth of the at least one annular groove 38 in the rotor 20 and of the connecting groove 40 in the housing end wall 14, 16 is between 0.1 and 2 mm, for example; preferably, the width of the grooves 38, 40 is greater than their depth.

FIG. 4 shows the vane pump according to a second exemplary embodiment whose essential design is the same as in the first exemplary embodiment. The two end surfaces 201, 202 of the rotor 20 each have at least one annular groove 3 8 let into them, with the annular grooves 38 of the one end surface 201 extending over a different circumference region of the rotor 20 than the annular grooves 38 of the other end surface 202. In the exemplary embodiment shown, the rotor 20 has four grooves 24; two annular grooves 383 of the one end surface 201 are situated diametrically opposite each other and each extend over approximately 90° between two successive grooves 24. The two annular grooves 384 of the other end surface 202 likewise extend over approximately 90°, but are offset by 90° in relation to the grooves 383 of the end surface 201 so that they do not overlap, and likewise each extend between two successive grooves 24. The annular grooves 384 of the end surface 202 are depicted with dashed lines in FIG. 4 since they are on the opposite end surface 202 of the rotor 20 and are therefore not actually visible in FIG. 4. The embodiment according to FIG. 4 can also be transferred to other embodiments of the rotor 20 in which the rotor 20 has an even number of grooves 24. In this case, the annular grooves 38 on each end surface 201, 202 of the rotor 20 each extend only between two successive grooves 24 and the annular grooves 38 of the two end surfaces 201, 202 are offset from one another in the circumference direction so that they do not overlap one another. Due to this arrangement of the annular grooves 38, at least essentially no force is exerted on the rotor 20 in the direction of the rotation axis 13, which would push the rotor 20 against one of the housing end walls 14, 16 and therefore lead to an increased amount of wear. The leakage through the sealing region 39 can also be kept to a minimum.

The foregoing relates to the preferred exemplary embodiment of the invention, it being understood that other variants and embodiments thereof are possible within the spirit and scope of the invention, the latter being defined by the appended claims.

The invention claimed is:

1. A vane pump comprising:

a pump housing (10);

a rotor (20) rotatably contained in the pump housing having a rotational axis (13);

a drive shaft (12) rotatably driving the rotor (20);

a plurality of grooves (24) distributed over the rotor (20) on its circumference, the plurality of grooves (24) extending at least essentially radially in relation to the rotation axis (13) of the rotor (20);

a vane-shaped delivery element (26) guided in each of the plurality of grooves (24) in sliding fashion, the delivery elements (26) delimiting radially inner internal regions (25) in the grooves (24) of the rotor (20);

a circumference wall (18) of the pump housing (10) encompassing the rotor (20) and extending eccentrically in relation to the rotation axis (13) of the rotor (20), against which wall (18) the radially outer ends of the delivery elements (26) rest;

housing end walls (14, 16) of the pump housing (10) adjoining the rotor (20) in the direction of its rotation axis (13), whereby the rotating motion of the rotor (20) causes the delivery elements (26) to deliver medium from a suction region to a pressure region that is offset from it in the rotation direction (21) of the rotor (20); and at least one annular groove (38; 381, 382; 383, 384) that extends over at least a part of the circumference of the rotor (20) is provided, which is connected to the internal region (25) of at least two of the grooves (24) of the rotor (20), wherein the at least one annular groove (38; 381, 382; 383, 384) is situated in at least one end surface (201, 202) of the rotor (20) facing one of the housing end walls (14, 16) and the at least one annular groove (38; 381, 382; 383, 384) is connected to the pressure region, wherein said pressure region includes a pressure opening (32) and a pressure groove in one of said housing end walls, and said pressure opening feeds directly into said pressure groove, wherein said suction region includes a suction opening (28) and a suction groove (30) in one of said housing end walls, and said suction opening feeds directly into said suction groove, wherein either a connecting groove (40) or a bore extends from the pressure groove to the annular groove and forms a connection between the pressure groove and the annular groove, and wherein either the connecting groove (40) or the bore is substantially tangential to both the pressure groove and the annular groove.

2. The vane pump according to claim 1, wherein at least one annular groove (38; 381, 382; 383, 384) is provided in both end surfaces (201, 202) of the rotor (20) and at least one of the annular grooves (38; 381, 382; 383, 384) is connected to the pressure region (32, 34).

3. The vane pump according to claim 2, wherein the at least one annular groove (383) in one end surface (201) of the rotor (20) extends over a different circumference region of the rotor (20) than the at least one annular groove (384) in the other end surface (202) of the rotor (20).

4. The vane pump according to claim 3, wherein an even number of grooves (24) are provided in the rotor (20) and the annular grooves (383, 384) situated in different end surfaces (201, 202) of the rotor (20) respectively connect only the internal regions (25) of two successive grooves (24) to each other.

5. The vane pump according to claim 4, wherein the at least one annular groove (38; 381, 382; 383, 384) is provided in the rotor (20) in the initial forming process.

6. The vane pump according to claim 5, wherein the rotor (20) is manufactured by means of a pressing, forging, or sintering process and is in particular composed of a sintered metal.

7. The vane pump according to claim 3, wherein the at least one annular groove (38; 381, 382; 383, 384) is provided in the rotor (20) in the initial forming process.

8. The vane pump according to claim 7, wherein the rotor (20) is manufactured by means of a pressing, forging, or sintering process and is in particular composed of a sintered metal.

9. The vane pump according to claim 2, wherein the at least one annular groove (38; 381, 382; 383, 384) is provided in the rotor (20) in the initial forming process.

10. The vane pump according to claim 9, wherein the rotor (20) is manufactured by means of a pressing, forging, or sintering process and is in particular composed of a sintered metal.

11. The vane pump according to claim 1, wherein the at least one annular groove (38; 381, 382; 383, 384) is provided in the rotor (20) in the initial forming process.

12. The vane pump according to claim 11, wherein the rotor (20) is manufactured by means of a pressing, forging, or sintering process and is in particular composed of a sintered metal.

13. The vane pump according to claim 1, wherein the pump is provided with only one suction opening and only one pressure opening, and wherein the suction opening and the pressure opening are each provided in only one respective end wall, said suction opening being provided in one end wall and said pressure opening being provided in the other end wall.

* * * * *